US010426206B2

(12) United States Patent
Davis et al.

(10) Patent No.: US 10,426,206 B2
(45) Date of Patent: Oct. 1, 2019

(54) ARTICLE OF APPAREL UTILIZING ZONED VENTING AND/OR OTHER BODY COOLING FEATURES OR METHODS

(71) Applicant: NIKE, Inc., Beaverton, OR (US)

(72) Inventors: Carrie L. Davis, Portland, OR (US); Ian H. Muir, Beaverton, OR (US); Loren G. Myhre, Portland, OR (US); Lashurya M. Wise, Portland, OR (US); Michael R. Baron, Tigard, OR (US); Jordan J. Wand, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 402 days.

(21) Appl. No.: 15/214,097

(22) Filed: Jul. 19, 2016

(65) Prior Publication Data

US 2016/0324226 A1 Nov. 10, 2016

Related U.S. Application Data

(60) Division of application No. 14/024,104, filed on Sep. 11, 2013, now abandoned, which is a continuation of (Continued)

(51) Int. Cl.
*A41D 13/005* (2006.01)
*A41D 27/28* (2006.01)

(Continued)

(52) U.S. Cl.
CPC ..... *A41D 13/0056* (2013.01); *A41D 1/04* (2013.01); *A41D 13/002* (2013.01);

(Continued)

(58) Field of Classification Search
CPC .. A41D 13/0056; A41D 13/0058; A41D 1/04; A41D 13/0015; A41D 13/002; A41D 13/0053; A41D 27/28

(Continued)

(56) References Cited

U.S. PATENT DOCUMENTS 179,661 A 7/1876 Lee
308,244 A 11/1884 Fishel (Continued)

FOREIGN PATENT DOCUMENTS

CN 1326712 A 12/2001
CN 101348971 A 1/2009

(Continued)

OTHER PUBLICATIONS

Matt B Brearley, James Paul Finn, Pre-cooling for Performance in the Tropics, SportScience, https://www.sportsci.org/jour/03/mbb.htm, Published Dec. 2003, see whole article and Table 1 (Year: 2003).*

(Continued)

*Primary Examiner* — Alissa L Hoey
(74) *Attorney, Agent, or Firm* — Banner & Witcoff, Ltd.

(57) ABSTRACT

Garments may include: (a) one garment portion having an air permeability of less than 550 $ft^3$/min per $ft^2$; and (b) another garment portion including one or more vented zones, wherein a material forming the vented zones has an air permeability of at least 550 $ft^3$/min per $ft^2$. The vented zones may extend along a center back portion and/or along at least one side portion of the garment. Methods for forming such garments may include: (a) providing one garment portion having an air permeability of less than 550 $ft^3$/min per $ft^2$; (b) providing another garment portion including at least one vented zone, wherein a material forming the vented zone has an air permeability of at least 550 $ft^3$/min per $ft^2$; and (c) forming a garment structure including these garment portions. The vented zones may extend along a center back portion and/or along at least one side portion of the garment structure. In some instances, apparel or equipment (including garments having zoned venting) may be wetted and (Continued)

worn by the athlete prior to the event or exercise, in order to pre-cool the athlete's body.

7 Claims, 10 Drawing Sheets

Related U.S. Application Data application No. 10/839,695, filed on May 6, 2004, now Pat. No. 8,555,414.

(51) Int. Cl.
*A41D 13/002* (2006.01)
*A41D 1/04* (2006.01)
*A41D 13/00* (2006.01)

(52) U.S. Cl.
CPC ..... *A41D 13/0015* (2013.01); *A41D 13/0053* (2013.01); *A41D 27/28* (2013.01)

(58) Field of Classification Search
USPC ..... 2/69
See application file for complete search history.

(56) References Cited

U.S. PATENT DOCUMENTS 601,489 A 3/1898 Tim
1,118,792 A 11/1914 Nicholas
1,252,187 A 1/1918 Shane
1,350,169 A 8/1920 Mullane
1,973,419 A 9/1934 Trageser
2,079,980 A 5/1937 Anders
2,391,535 A 12/1945 Zelano
D170,723 S 10/1953 Secosky
2,715,226 A 8/1955 Weiner
2,846,687 A 8/1958 Lippman
D192,135 S 1/1962 Tiso et al.
D192,136 S 1/1962 Tiso et al.
3,045,243 A 7/1962 Lash
3,078,699 A 2/1963 Huntley
3,086,215 A 4/1963 Di Paola
3,153,793 A 10/1964 Lepore
3,296,626 A 1/1967 Ludwikowski
3,710,395 A 1/1973 Spano et al.
3,761,962 A 10/1973 Myers
3,801,987 A 4/1974 Thompson, Jr.
4,126,903 A 11/1978 Horton
4,185,327 A 1/1980 Markve
4,195,364 A 4/1980 Bengtsson et al.
4,513,451 A 4/1985 Brown
4,608,715 A 9/1986 Miller et al.
4,619,004 A 10/1986 Won
4,641,655 A * 2/1987 Abt ..... A61F 7/10 383/901
4,722,099 A 2/1988 Kratz
4,736,467 A 4/1988 Schwarze et al.
4,804,351 A 2/1989 Raml et al.
4,805,619 A * 2/1989 Swearingen ..... A61F 7/103 383/901
4,807,303 A 2/1989 Mann et al.
4,887,317 A 12/1989 Phillips, Sr. et al.
4,932,078 A 6/1990 Jones et al.
4,953,544 A * 9/1990 Hansen ..... A61F 7/10 428/903
4,996,723 A 3/1991 Huhn et al.
5,027,438 A 7/1991 Schwarze et al.
5,033,118 A 7/1991 Lincoln
5,105,478 A 4/1992 Pyc
5,206,080 A 4/1993 Tashiro et al.
5,232,769 A 8/1993 Yamato et al.
5,282,277 A 2/1994 Onozawa
5,320,164 A 6/1994 Szczesuil et al.
5,469,581 A 11/1995 Uthoff
5,597,577 A * 1/1997 Mathewson ..... A41D 20/005 424/400
5,608,913 A 3/1997 Lacoste
5,642,526 A 7/1997 Thompson
5,659,895 A 8/1997 Ford, Jr.
5,692,380 A * 12/1997 Cox ..... F25D 7/00 2/181
5,704,064 A 1/1998 van der Sleesen
5,727,256 A 3/1998 Rudman
5,755,110 A * 5/1998 Silvas ..... A41D 13/0053 165/46
5,901,373 A 5/1999 Dicker
6,018,819 A 2/2000 King et al.
6,061,829 A 5/2000 Gunn
6,125,645 A * 10/2000 Horn ..... A41D 13/0056 2/458
6,248,710 B1 6/2001 Bijsterbosch et al.
6,279,161 B1 8/2001 Johnston
6,282,717 B1 9/2001 Ng
6,319,599 B1 11/2001 Buckley
6,332,221 B1 12/2001 Gracey
6,339,845 B1 1/2002 Bums et al.
D457,709 S 5/2002 Davis
6,401,250 B1 6/2002 McNabb
6,430,764 B1 8/2002 Peters
6,550,474 B1 4/2003 Anderson et al.
6,640,715 B1 11/2003 Watson et al.
6,647,549 B2 11/2003 McDevitt et al.
6,723,669 B1 4/2004 Clark et al.
D491,713 S 6/2004 Wilson, II
6,745,400 B1 6/2004 Paciorkowski
6,767,850 B1 7/2004 Tebbe
7,043,766 B1 5/2006 Foreman et al.
7,437,774 B2 10/2008 Baron et al.
7,560,399 B2 7/2009 Rock et al.
7,754,626 B2 7/2010 Baron et al.
8,015,618 B2 * 9/2011 Paull ..... A41D 13/0053 2/69
8,182,826 B2 * 5/2012 Whitmire ..... A01N 31/02 424/401
8,499,367 B2 * 8/2013 Almqvist ..... A61F 7/02 2/458
8,555,414 B2 10/2013 Davis et al.
9,271,530 B2 * 3/2016 Kobayashi ..... A41D 13/0056
2002/0112499 A1 8/2002 Goldfine
2002/0147483 A1 * 10/2002 Bumbarger ..... A41D 31/0027 607/108
2002/0189608 A1 12/2002 Raudenbush
2003/0007927 A1 1/2003 Barrett et al.
2003/0061650 A1 4/2003 Emanuel
2003/0079271 A1 5/2003 Gillen et al.
2003/0114810 A1 6/2003 Weber
2003/0182705 A1 10/2003 Spongberg
2004/0132367 A1 7/2004 Rock
2004/0158910 A1 8/2004 Bay
2004/0176005 A1 9/2004 Nordstrom
2004/0226077 A1 * 11/2004 Toth ..... A42B 3/10 2/411
2005/0053759 A1 3/2005 Rock et al.
2005/0204448 A1 9/2005 Wise et al.
2005/0204449 A1 9/2005 Baron et al.
2005/0208266 A1 9/2005 Baron et al.
2005/0208283 A1 9/2005 Baron et al.
2005/0208850 A1 9/2005 Baron et al.
2005/0208857 A1 9/2005 Baron et al.
2005/0208859 A1 9/2005 Baron et al.
2005/0208860 A1 9/2005 Baron et al.
2005/0246813 A1 11/2005 Davis et al.
2006/0179539 A1 8/2006 Harber
2006/0223400 A1 10/2006 Yasui et al.
2006/0270293 A1 11/2006 Yasui et al.
2006/0276089 A1 * 12/2006 Amarasinghe ..... A41D 13/0053 442/121
2007/0050886 A1 3/2007 Brassill
2007/0074326 A1 * 4/2007 Komechak ..... A42B 1/008 2/12
2007/0204808 A1 * 9/2007 Harada ..... A01K 13/006 119/850

(56) References Cited

U.S. PATENT DOCUMENTS

| | | | | |
|---|---|---|---|---|
| 2008/0040839 | A1* | 2/2008 | Gordon | A41D 13/0053 2/455 |
| 2008/0229473 | A1 | 9/2008 | Baron et al. | |
| 2008/0311166 | A1* | 12/2008 | Wimer | A61K 8/0208 424/402 |
| 2010/0242151 | A1 | 9/2010 | Mather | |
| 2010/0286755 | A1* | 11/2010 | Gallaher | A41D 13/0053 607/108 |
| 2011/0034887 | A1* | 2/2011 | Forden | A61F 7/10 604/291 |
| 2011/0296590 | A1* | 12/2011 | Czech | A41D 13/0053 2/327 |
| 2012/0190259 | A1* | 7/2012 | Frost | A41D 13/0125 442/301 |
| 2012/0227856 | A1* | 9/2012 | Sinacori | D03D 1/00 139/420 R |
| 2014/0137310 | A1* | 5/2014 | Malone | A42B 1/008 2/171.2 |
| 2015/0000004 | A1* | 1/2015 | Silverberg | A41D 13/0058 2/69 |
| 2015/0026862 | A1* | 1/2015 | Silverberg | A41D 13/0058 2/69 |
| 2015/0173432 | A1* | 6/2015 | McCoy | A41D 13/0056 62/259.3 |
| 2016/0108565 | A1* | 4/2016 | McCoy | A47K 10/02 428/85 |
| 2016/0249691 | A1* | 9/2016 | Gordon | A41D 13/0053 2/102 |
| 2017/0013890 | A1* | 1/2017 | Byrne | A41D 13/0058 |
| 2017/0087010 | A1* | 3/2017 | Howard | A61L 31/14 |
| 2017/0304112 | A1* | 10/2017 | Burstein | A61F 7/10 |
| 2017/0367917 | A1* | 12/2017 | Donat | A41D 1/002 |

FOREIGN PATENT DOCUMENTS

| | | | |
|---|---|---|---|
| CN | 1949990 | B | 8/2012 |
| DE | 1435981 | A1 | 3/1969 |
| DE | 2702407 | A1 | 7/1978 |
| DE | G 85 33 733.1 | | 5/1986 |
| EP | 1329167 | A2 | 7/2003 |
| EP | 1640488 | A1 | 3/2006 |
| EP | 1803844 | A1 | 7/2007 |
| GB | 2108822 | A | 5/1983 |
| GB | 2193429 | A | 2/1988 |
| JP | S5751802 | | 3/1982 |
| JP | 57051802 | | 3/1985 |
| JP | 01-089917 | U | 6/1989 |
| JP | 08-003804 | | 7/1996 |
| JP | 2001049513 | A | 2/2001 |
| JP | 2004100126 | A | 4/2004 |
| JP | S27-002660 | | 7/2011 |
| JP | S13-002317 | | 12/2011 |
| SE | 198705 | C | 3/1965 |
| WO | 1991009544 | A1 | 7/1991 |
| WO | 2005110135 | A2 | 11/2005 |

OTHER PUBLICATIONS

Part 3 of Grounds of Appeal Filed Aug. 14, 2013 in EP Opposition to EP Patent 1746909, With Documents Cited Within Grounds of Appeal Document.

Part 3 of Grounds of Appeal Filed Aug. 14, 2013 in EP Opposition to European Patent 1746909, With Documents Cited Within Grounds of Appeal Document.

Regenold, "Look Cool in Hot Times With Eco-Mesh", Internet Article Dated Apr. 17, 2004.

Reply to Appeal by Opposer Filed Feb. 25, 2014 in EP Opposition to European Patent 1746909.

S.C.O. Ugbolue, 'The Air-Permeability and Bulk of Plain-Knitted Fabrics', Journal of the Textile Institute, vol. 66, Issue 8, pp. 297-299 (1975).

V.K. Kothari & A. Newton, 'The Air-Permeability of Non-Woven Fabrics', Journal of the Textile Institute, vol. 65, Issue 10, pp. 525-531 (1974).

Weisley, "Grand Canyon Hike", Internet Article Dated Apr. 21, 2004.

Anonymous, "Adidas CLIMA Cool", Internet Article Dated Jul. 12, 2005.

Anonymous, "Apparel-Adidas", Internet Article Dated Apr. 21, 2004.

Anonymous, "Loughborough University and Adidas Join Forces to Help Olympians Beat the Heat in Athens", Internet Article Dated Jul. 7, 2004.

Applicant Submission to EPO Prior to Oral Proceeding in EP Patent 1746909 Dated Jan. 24, 2013.

Enclosure A10, 'Alleged Public Prior Use AC Milan Shirt, Sample 1'—As Filed With Opposition to EP Patent 1746909 on Sep. 9, 2010 by Opponent Adidas AG.

Enclosure A11, 'Congnos Net Sales Cube 2000:AC Milan_Home Jersey_Art. NR. 022245, Net Sales_Net Quantity FY2003-2007'—As Filed With Opposition to EP Patent No. 1746909 on Sep. 9, 2010 by Opponent Adidas AG.

Enclosure A12, 'Pictures of the Test Setup for Measuring the Air Permeability of A10 According to A9'—As Filed With Opposition to EP Patent No. 1746909 on Sep. 9, 1020 by Opponent Adidas AG.

Enclosure A13, 'Anonymous: Adidas—Replica 2003/2007 NR 509 Deutschland', Adidas-Salomon AG, Herzogenaurauch, 12/02, Art. NR. 000131'—As Submitted With Opponent's Letter to EPO Regarding EP Patent No. 1746909 on Oct. 26, 2011.

Enclosure A14, 'Alleged Public Prior Use AC Milan Shirt, Sample 2'—As Submitted With Opponent's Letter to EPO Regarding EP Patent No. 1746909 on Oct. 26, 2011.

Enclosure A16, 'Order Confirmation of an Apr. 2003 AC Milan Home Shirt Inzaghi #9 W/Tags XL Artikelnummer: ACMH03RS4 by Classic Footbal Company Ltd, Dated Aug. 4, 2011', As Submitted With Opponent's Letter to EPO Regarding Oral Hearing in EP Patent 1746909 on Dec. 21, 2012.

Enclosure A17, 'Anonymous: Adidas—Replica 2002/2003 NR 506 Deutschland', (Cover Page & One Additional Page) & Anonymous: Adidas—Replica 2003/2004 NR 509 Deutschland', (Cover Page & One Additional Page, (See Also A13),—As Submitted With Opponent's Letter to EPO Regarding Oral Hearing in EP Patent 1746909 on Dec. 21, 2012.

Enclosure A18, 'Signatures Not Readable: Two Pages of Test Results From Frazier Precision Instrument Company, Inc. Dated Sep. 20, 2012',—As Submitted With Opponent's Letter to EPO Regarding Oral Hearing in EP Patent 1746909 on Dec. 21, 2012.

Enclosure A19, 'Eschenwecker, Silvia: Letter to Testing Services, Attn J. Scrivener, 925 Sweeney Drive, Hagerstown, MD 21740 Use, Including Instruciton of How to Perform Air Permeability Tests, Sep. 6, 2012',—As Submitted With Opponenet's Letter to EPO Regarding Oral Hearing in EP Patent 1746909 on Dec. 21, 2012.

Enclosure A20, 'Affidavit of Mr. Scrivener Dated Nov. 27, 2012 Apparently Referring to A18',—As Submitted With Opponenet's Letter to EPO Regarding Oral Hearing in EP Patent 1746909 on Dec. 21, 2012.

Enclosure A9, 'ASTM D737-96'As Filed With Opposition to EP Patent No. 17469099 (Formerly Application 05734332.9 on Sep. 9, 2010 by Opponent Adidas AG.

European Patent Office's Revocation of EP Patent 1746909 Dated Apr. 4, 2013, With Facts and Reasons for Decision.

European Patent Office's Revocation of EP Patent 1746909 Dated Apr. 4, 2013, With Reasons for Decision.

International Preliminary Report on Patentability dated Nov. 7, 2006 for Application PCT/US2005/012209.

International Search Report and Written Opinion dated Nov. 3, 2005 for Application PCT/US2005/012209.

Internet Prinout: http://niketown.nike.com, "New Sphere Yoked Short-Sleeve Top" Dated Apr. 9, 2004.

Internet Printout: http://niketown.nike.com, "Dri-Fit One Mesh Tank" Dated Mar. 22, 2004.

Internet Printout: http://niketown.nike.com, "Global NIKE Sphere Polo" Dated Apr. 9, 2004.

(56) References Cited

OTHER PUBLICATIONS

Internet Printout: http://niketown.nike.com, "Global NIKE Sphere Top" Dated Apr. 9, 2004.
Internet Printout: http://niketown.nike.com, "NIKE Pro Vent Dri-Fit Long Sleeve Top" Dated Mar. 22, 2004.
Internet Printout: http://niketown.nike.com, "NIKE Pro Vent Dri-Fit Sleeveless Top" Dated Mar. 22, 2004.
Internet Printout: http://niketown.nike.com, "NIKE Sphere Switch-back Short Sleeve" Dated Apr. 9, 2004.
Internet Printout: http://niketown.nike.com, "NIKE Sphere Ultra-light Tank" Dated Apr. 9, 2004.
Internet Printout: http://niketown.nike.com, "NIKE Sphere Yoked Sleeveless Top" Dated Apr. 9, 2004.
Internet Printout: http://niketown.nike.com, "UV Dri-Fit Long Sleeve Top" Dated Mar. 22, 2004.
Internet Printout: http://niketown.nike.com,"Dri-Fit One Long Short" Dated Mar. 22, 2004.
Internet Printout: http//realtytimes.com—Agent News and Advice, Dated Mar. 24, 2004.
Internet Printout: http://niketown.nike.com, "NIKE Pro Vent Dri-Fit Short Sleeve Top" Dated Mar. 22, 2004.
Internet Printout: http://niketown.nike.com, "NIKE Sphere Dry Crew" Dated Apr. 9, 2004.
Internet Printout: http://niketown.nike.com, "NIKE Sphere Ultra-light Top" Dated Apr. 9, 2004.
Internet Printout: http://niketown.nike.com, 'NIKE Sphere Switch-back Long Sleeve' Dated Apr. 9, 2004.
Internet Printout: http://niketown.nike.com, NIKE Sphere Ultralight Tank Dated Mar. 22, 2004.
Joan Lord, 'The Determination of the Air Permeability of Fabrics', Journal of the Textile Institute Transactions, vol. 50, Issue 10, pp. 569-582 (1959).
Minutes of Oral Proceedings Held Jan. 31, 2013 in EP Opposition to Patent 1746909.
Notice of European Patent Office Appeal Filed Jun. 4, 2013 in Revoked EP Patent 1746909.
Office Action dated Mar. 10, 2010 for Japanese Application 2007-511380.
Office Action dated Jan. 14, 2008 for European Application 05734332.9.
Office Action dated May 21, 2009 for Japanese Application 2007-511380, With English Translation.
Office Action dated Mar. 23, 2011 for Japanese Application 2007-511380.
Office Action dated Mar. 27, 2007 for European Application 05734332.9.
Office Action dated Nov. 3, 2011 for Chinese Application 20050013911.7.
Office Action dated Jul. 31, 2008 for European Application 05734332.9.
Part 1 of Grounds of Appeal Filed Aug. 14, 2013 in EP Opposition to EP Patent 1746909, With Auxiliary Requests 1-10.
Part 1 of Grounds of Appeal Filed Aug. 14, 2013 in EP Opposition to European Patent 1746909, With Auxiliary Requests 1-10.
Part 2 of Grounds of Appeal Filed Aug. 14, 2013 in EP Opposition to EP Patent 1746909, With Auxiliary Requests 11-20.
Part 2 of Grounds of Appeal Filed Aug. 14, 2013 in EP Opposition to European Patent 1746909, With Auxiliary Requests 11-20.

* cited by examiner

ARTICLE OF APPAREL UTILIZING ZONED VENTING AND/OR OTHER BODY COOLING FEATURES OR METHODS

RELATED APPLICATION DATA

This application is a divisional application of pending U.S. patent application Ser. No. 14/024,104 filed Sep. 11, 2013 titled "Article of Apparel Utilizing Zoned Venting and/or Other Body Cooling Features or Methods", which is a continuation of U.S. patent application Ser. No. 10/839,695, filed May 6, 2004, (now U.S. Pat. No. 8,555,414) titled "Article of Apparel Utilizing Zoned Venting and/or Other Body Cooling Features or Methods", all of which are entirely incorporated herein by reference.

FIELD OF THE INVENTION

Aspects of the present invention generally relate to apparel including vented zones at targeted locations in the garment structure to provide enhanced or improved cooling effects. Pre-wetting an athlete's apparel or other equipment, including pieces of apparel having zoned venting characteristics, in a pre-event or pre-exercise body cooling routine, also may slow the rate-of-rise and help regulate body temperature and improve the athlete's performance.

BACKGROUND

One of the biggest challenges athletes face when competing or training, particularly in moderate to hot temperature conditions, is heat. Not only must the athlete cope with heat from the external environment, but he/she also must cope with heat generated within his/her own body as a result of physical exertion.

Substantial heat may be generated in a person's body as a result of physical activity and exertion. In general, a body's core temperature rises with increased physical activity. Less than 25% of the energy created during physical activity is converted into work energy (e.g., energy used to move the body and/or resist an applied force). The remaining 75%+ of the created energy typically must be dissipated as released heat. The human body's most effective mechanism for dealing with excess heat is through evaporative cooling. When a person's core body temperature rises to a certain level, the body will start to sweat. When this liquid sweat evaporates, the physical conversion of the liquid to its corresponding gas form (i.e., the drying) draws heat from the nearest heat source. In the case of sweat, the nearest heat source is the skin. In this manner, sweating cools a person due to the evaporative cooling action as the sweat dries. This evaporation of sweat is dependent upon the water vapor pressure (or relative humidity) of the air in contact with the skin. Air movement also is an important factor. For example, ambient air gains humidity as it picks up moisture during the evaporation of sweat. In the absence of adequate air movement (ventilation), this humidified air becomes trapped in areas surrounding the skin, thus inhibiting the cooling provided by the continued evaporation of sweat.

Failure to properly release and move heat away from the body during exercise in a warm environment can cause a dangerous rise in the person's body temperature, potentially resulting in adverse health consequences, such as heat exhaustion or heat stroke.

Various known garment features are available and used to assist athletes in coping with excess heat generated as a result of physical exertion. For example, mesh venting has been used in garments to help dissipate heat. In sports apparel, it is common to see underarm vents provided by very small or closed-hole meshes, or by small eyelets provided through the fabric. While helpful, such meshes or vents typically are too small or too impermeable to provide adequate cooling effects. Additionally, such vents typically are not large enough and/or located at targeted positions so as to provide improved cooling action.

Known garments or other athletic equipment also do little or nothing to help prepare an athlete for core body temperature increases that accompany an athletic event or exercise routine. In many instances, a garment and/or a training or preparation method that helps regulate core body temperature prior to, during, and/or after an event or exercise routine may be useful to improve or maximize the athlete's performance, e.g., by helping to cool the body to reduce core body temperature prior to the event, to slow the rate-of-rise in core temperature during the event, and/or to cool the body after the event.

Accordingly, it would be advantageous to provide apparel with targeted vented zones at targeted locations of the body to improve cooling action, and in many instances, to optimize and/or maximize the cooling action on the body. Such venting, in at least some instances, would improve the athlete's comfort and/or performance during the physical activity. Additionally, it would be advantageous to provide apparel and/or other athletic equipment and/or a preparation method that first anticipates the onset of heat stress and then enhances the body's thermoregulatory mechanism to function properly, e.g., to cool the body, before, during, and/or after the event or exercise routine.

SUMMARY

Aspects of the present invention relate to garments that include targeted vented zones that assist in efficiently and effectively cooling the wearer. Such garments may include, for example: (a) a first garment portion formed of a fabric material, wherein the first garment portion has a maximum air permeability of less than 550 $ft^3$/min per $ft^2$; and (b) a second garment portion forming a garment structure with at least the first garment portion, wherein the second garment portion includes a first vented zone, wherein a material forming the first vented zone has a minimum air permeability of at least 550 $ft^3$/min per $ft^2$, and wherein the first vented zone is at least 12 $in^2$ and is provided at a targeted location in the garment structure to cool the wearer's body. The vented zone may be any desired size without departing from the invention, for example, at least 20 $in^2$, or even at least 30 $in^2$. One or more additional garment portions including one or more additional vented zones like those described above may be included in the garment structure without departing from the invention. Such additional vented zones may be maintained separate from the first vented zone and/or separate from one another. In at least some examples of the invention, the first garment portion may form a majority of the garment structure.

Additional aspects of the invention relate to methods for forming garments having targeted vented zones like those described above. Such methods may include, for example: (a) providing a first garment portion formed of a fabric material, wherein the first garment portion has a maximum air permeability of less than 550 $ft^3$/min per $ft^2$; (b) providing a second garment portion including a first vented zone, wherein a material forming the first vented zone has a minimum air permeability of at least 550 $ft^3$/min per $ft^2$, and wherein the first vented zone is at least 12 $in^2$, and in some examples may be at least 20 $in^2$, or even at least 30 $in^2$; and (c) forming a garment structure including at least the first garment portion and the second garment portion, wherein the first vented zone is provided at a targeted location in the garment structure to cool the wearer's body. If desired, the garment structure may be formed to include a plurality of separate vented zones, as generally described above.

Still additional aspects of the invention relate to systems and methods for cooling an athlete's body before, during, and/or after an event or exercise routine. Such systems may include, for example: (a) a piece of apparel or athletic equipment; and (b) a container for receiving liquid and the piece of apparel or athletic equipment. The container further may include indicia indicating at least one amount of liquid to be included in the container to wet the piece of apparel or athletic equipment prior to it being donned by a wearer. Methods for using such body cooling systems may include, for example: (a) wetting a piece of apparel or athletic equipment; (b) at least 20 minutes prior to a start of an event or an exercise routine, donning the wetted piece of apparel or athletic equipment and wearing it in a wetted condition (e.g., with the wearer maintaining a resting or relatively inactive state) so as to cool the wearer's body prior to the start; and (c) participating in the event or exercise routine. Optionally, all or part of the wetted piece of apparel or athletic equipment may be worn during and/or after the event or exercise routine, and/or some or all of it may be removed before the event or exercise begins and/or while it is occurring. Garments like those described above, including one or more vented zones, may be wetted and used in systems and methods according to at least some examples of this invention.

BRIEF DESCRIPTION OF THE DRAWINGS

The above and other objects, features, and advantages of the present invention will be more readily apparent and more fully understood from the following detailed description, taken in conjunction with the appended drawings, in which.

DETAILED DESCRIPTION

Figure 1:
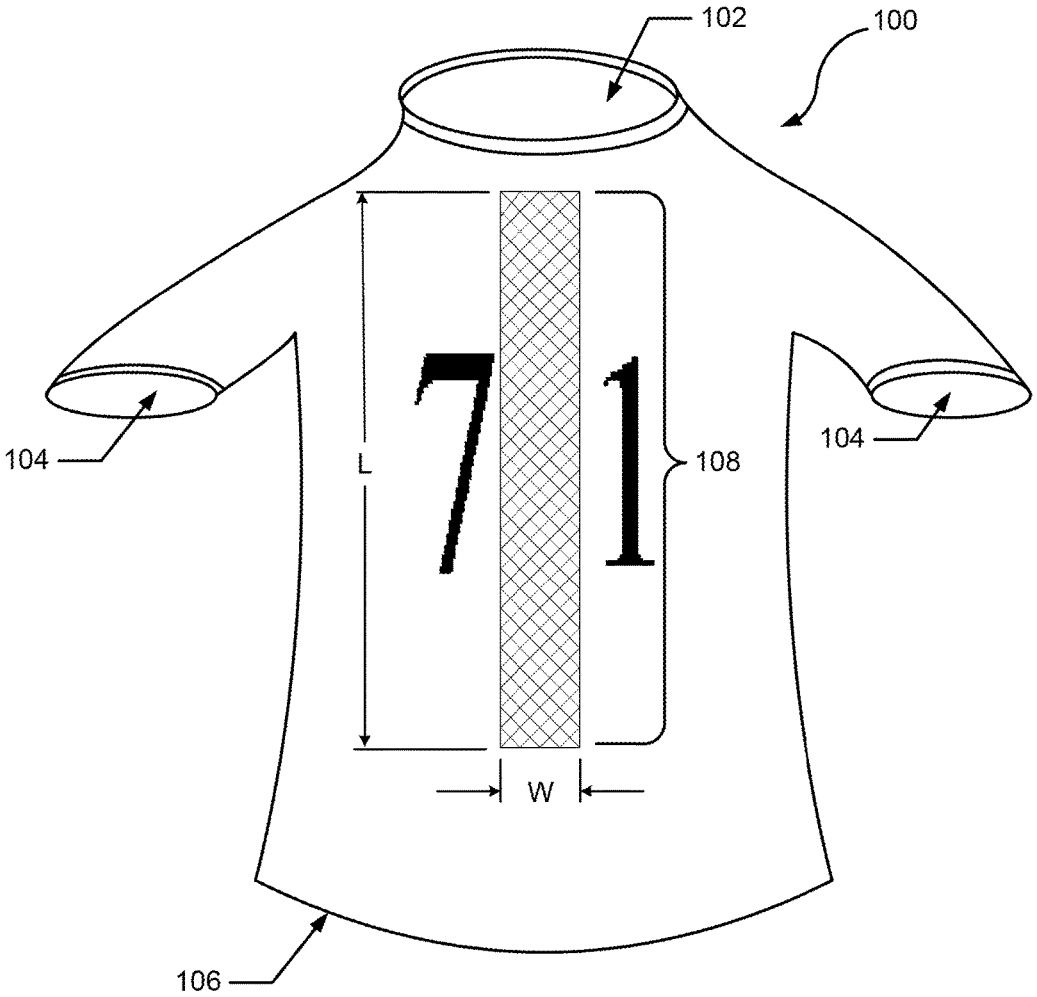
FIG. 1 illustrates an example upper torso garment in accordance with the invention having a center back vented zone.

Various specific examples of the invention are described in detail below in conjunction with the attached drawings. To assist the reader, this specification is divided into various subsections, as follows: Terms; General Description of Aspects of the Invention; Specific Examples of the Invention; and Conclusion.

A. Terms

The following terms are used in this specification, and unless otherwise noted or clear from the context, these terms have the meanings provided below.

"Air permeability," as used in this specification, means the volume of air (e.g., in cubic feet) that passes through a given area of the material tested (e.g., a square foot) in a given time period (e.g., a minute) under predetermined testing conditions. While various ways of measuring air permeability of a material are known and may be used, one suitable method of measuring air permeability involves the use of a Frazier Low Pressure Air Permeability Machine 750 using standard test ASTM D737-96.

A given type of material (e.g., a polyester, spandex, cotton, wool, or other type of material) may have a wide range of different air permeabilities, depending on various factors associated with the specific material sample. For example, the air permeability characteristics of a given material may depend on various characteristics of the ultimate fabric sample containing the material, such as: thread or fiber thickness; thread or fiber count; yarn twist; weave or knit density; weave or knit construction; material or weave flexibility or stretchability; the presence or absence of mesh openings (or other openings); the mesh or opening size; the percentage of material surface area covered by mesh or openings; fabric thickness; number of plies; surface and/or finishing treatments (if any); and the like. Accordingly, in at least some examples of this invention, the various "garment portions" having different air permeabilities, as these terms are used in the present specification, may be made from the same type of material, but characteristics of that material may be adjusted in at least one of the garment portions to alter its air permeability (e.g., the fabric may be treated or otherwise constructed or arranged in the vented zone to increase its air permeability as compared to the air permeability of the fabric at locations in the first garment portion (i.e., the portion not containing the vented zone) or the fabric in the first garment portion may be treated or otherwise constructed or arranged to lower its air permeability as compared to that of the material in the vented zone). In other examples of the invention, a different material may make up the vented zone as compared to the material in the first garment portion.

"Garment," as used in this specification, includes any type of wearing apparel for the torso, arms, and legs. "Garments" do not include hats, caps, gloves, or footwear).

B. General Description of Aspects of the Invention

In general, aspects of this invention relate to garments having vented zones at specifically targeted locations of the garment structure to improve cooling efficiency and effectiveness and thereby, in at least some instances, increase the athlete's comfort level and improve his or her performance. As described above, much heat energy is generated in an athlete's body as a result of physical exertion, and this heat energy must be dissipated in some manner to provide a more comfortable workout and/or to prevent the athlete's core body temperature from rising to dangerous levels. Physiological research conducted in connection with this invention demonstrated that if a limited area of mesh is positioned on an athlete's upper torso, applying those mesh panels to the sides and down the center of the back provided the most effective ventilatory cooling during work in heat. Garments having targeted venting zones provided at one or more of these locations allow a significant reduction in the core body temperature rise during exercise and physical exertion as compared to garments having no venting and garments having venting in other areas.

Garments having targeted venting in accordance with at least some aspects of this invention may include, for example: (a) a first garment portion formed of a fabric material, wherein the first garment portion has an air permeability of less than 550 $ft^3$/min per $ft^2$; and (b) a second garment portion forming a garment structure with at least the first garment portion, wherein the second garment portion includes a first vented zone, wherein a material forming the first vented zone has an air permeability of at least 550 $ft^3$/min per $ft^2$, and wherein the first vented zone is at least 12 $in^2$ and is provided at a targeted location in the garment structure to cool the wearer's body. The vented zone may be any desired size without departing from the invention, for example, at least 20 $in^2$, or even at least 30 $in^2$. One or more, additional garment portions including one or more additional vented zones like those described above may be included in the garment structure without departing from the invention. Such additional vented zones, when present, may be located separate from the first vented zone. In at least some examples of the invention, the first garment portion may form a majority of the garment structure.

Garments according to at least some more specific examples of the invention fit at least a portion of an upper torso of a wearer and include: (a) a first garment portion formed of a fabric material and having an air permeability of less than 550 $ft^3$/min per $ft^2$; and (b) a second garment portion forming a garment structure with at least the first garment portion, wherein the second garment portion includes a first vented zone, wherein a material forming the first vented zone has an air permeability of at least 550 $ft^3$/min per $ft^2$. In at least some examples, at least a portion of the first vented zone may be from about 2 to about 6 inches in a first dimension and at least about 10 inches in another dimension and extend along a center back portion of the garment structure. In other examples, at least a portion of the first vented zone may be from about 2 to about 6 inches in a first dimension and at least about 6 inches in another dimension and extend along a first side portion of the garment structure. Optionally, each side portion of the garments may include vented zones like those described above. As still another option, garments in accordance with at least some examples of this invention may include any combination or all of the center back vented zone and one or more side vented zones.

In at least some examples, the first garment portion may have an air permeability of less than 500 $ft^3$/min per $ft^2$, and even less than 450 $ft^3$/min per $ft^2$. Additionally or alternatively, at least some example garments will have a second garment portion having an air permeability of at least 600 $ft^3$/min per $ft^2$, and in some examples, the air permeability will be at least 700 $ft^3$/min per $ft^2$ and even at least 800 $ft^3$/min per $ft^2$.

Zoned venting, like that described above, helps keep an athlete cooler by increasing air flow over various targeted regions of the body (e.g., the center back and two sides). The body releases a significant amount of its excess heat in the center back area, and increased air flow in this region, via zoned venting, speeds up the evaporation of sweat from the skin, and hence, speeds up the evaporative cooling process (as described above). Additionally, this improved air flow moves fresh and relatively cool air into the targeted regions and moves the heated air out. Vented zones at the athlete's sides help improve intake and exhaust air flow when the body is moving forward or laterally, movement that typically occurs during exercise and/or sporting events. When vented zones are provided at the center back and both lateral sides, air can flow into the garment at the garment sides and around to the back and out, evaporating sweat and moving heated air away from the body.

In at least some studies, the rise in core body temperature during exercise when wearing an example garment in accordance with the invention (e.g., a garment having center back and two side vented zones) was between about 0.2° F. to 0.5° F. lower as compared to exercise under similar conditions wearing garments vented in other areas (with the same total venting area) and as compared to exercise under similar conditions wearing unvented garments. Although this may be meaningless to the athlete who is merely "warm," an increase of even a few tenths of a degree can be very distressing to the athlete who is approaching his/her limit of heat tolerance.

Additional aspects of the invention relate to methods for forming garments having targeted vented zones, e.g., like those described above. Such methods may include, for example: (a) providing a first garment portion formed of a fabric material, wherein the first garment portion has an air permeability of less than 550 $ft^3$/min per $ft^2$; (b) providing a second garment portion including a first vented zone, wherein a material forming the first vented zone has an air permeability of at least 550 $ft^3$/min per $ft^2$, and wherein the first vented zone is at least 12 $in^2$, and in some examples may be at least 20 $in^2$, or even at least 30 $in^2$; and (c) forming a garment structure including at least the first garment portion and the second garment portion, wherein the first vented zone is provided at a targeted location in the garment structure to cool the wearer's body. If desired, the garment structure may be formed to include a plurality of vented zones, as generally described above.

As a more specific example, for garments that fit at least a portion of an upper torso of a wearer, methods in accordance with some examples of the invention may include: (a) providing a first garment portion formed of a fabric material, wherein the first garment portion has an air permeability of less than 550 $ft^3$/min per $ft^2$; (b) providing a second garment portion including a first vented zone, wherein a material forming the first vented zone has an air permeability of at least 550 $ft^3$/min per $ft^2$, and wherein at least a portion of the first vented zone is from about 2 to about 6 inches in a first dimension and at least about 6 or at least about 10 inches in a second dimension; and (c) forming a garment structure including at least the first garment portion and the second garment portion, wherein the first vented zone extends along a center back portion of the garment structure or along a side portion of the garment structure. Again, plural vented zones may be included in the garment structure without departing from the invention.

As noted above, additional aspects of this invention relate to systems and methods for cooling an athlete's body during an event or exercise routine. Systems in accordance with at least some examples of this invention may include: (a) a piece of apparel or athletic equipment; and (b) a container for receiving liquid and the piece of apparel or athletic equipment. The container further may include instructions and/or indicia indicating at least one amount of a liquid (such as water) to be included in the container to wet the piece of apparel or athletic equipment prior to it being donned by a wearer. As another option, the container may be appropriately sized such that a user may place the piece of apparel or athletic equipment in the container and then fill (or substantially fill) the container with liquid. The container also may include a closure system, e.g., for holding the garment and the liquid in a liquid tight manner. The container may be repeatably openable and closeable, so that the garment can be wet repeatedly, if necessary or desired, e.g., for numerous events or exercise routines and/or for lengthy events or exercise routines.

In at least some examples, the piece of apparel or athletic equipment may constitute a garment for at least an upper torso of the wearer, optionally including one or more of the venting zones, such as the various garments described above.

Methods in accordance with these aspects of the invention may include, for example: (a) wetting a piece of apparel or athletic equipment; (b) at least 20 minutes prior to a start of an event or exercise routine, donning the wetted piece of apparel or athletic equipment and wearing it in a wetted condition (optionally while resting, maintaining a low level of physical activity, and/or staying in a cool environment) so as to cool a wearer's body prior to the start; and (c) participating in the event or exercise routine. In some instances, the athlete will continue resting, maintain a low activity level, and/or remain in a cool location for at least 20 minutes, in order to pre-cool the body prior to the event or exercise routine. Optionally, if desired, the piece of apparel or athletic equipment may be doffed prior to participating in the event or exercise routine, and further, if desired, it may be re-donned after the event or routine (optionally with re-wetting, if necessary) and used to cool the body after the event or routine. As another alternative, the piece of apparel or athletic equipment may be worn during and/or after the event or exercise routine, with re-wetting if and when necessary, to allow the athlete to benefit from the cooling effects before, during, and/or after the event or routine.

In at least some example methods according to the invention, the athlete further may warm up after donning the piece of apparel or athletic equipment and shortly before participating in the event or exercise routine. If desired, the athlete may warm up while wearing the pre-wetted piece of apparel or athletic equipment, to keep the athlete's body cool while the muscles are stretched and warmed up. The warm up may begin at any suitable time, such as after an initial pre-cooling time period of at least about 20 minutes and about 10 or 15 minutes before the event or exercise routine starts.

Specific examples of the invention are described in more detail below. The reader should understand that these specific examples are set forth merely to illustrate examples of the invention, and they should not be construed as limiting the invention.

C. Specific Examples of the Invention

1. Apparel Having Zoned Venting

The figures in this application illustrate various examples of apparel in accordance with this invention. When the same reference number appears in more than one drawing, that reference number is used consistently in this specification and the drawings to refer to the same part or element throughout.

FIG. 1 illustrates an example garment 100 in accordance with one example of this invention for at least partially fitting an upper torso of a wearer. The garment 100 includes a head or neck opening 102, two arm openings 104, and a waist opening 106, as is conventional and known in the art. While the garment 100 is shown as a short-sleeved athletic jersey, any desired garment style may be used without departing from the invention, including, for example: a long sleeved jersey; a tank top type jersey; a tight, body-fitting garment, such as a track suit, wrestling uniform, or leotard; and the like.

The garment 100 includes a vented zone 108 that extends along a center back portion of the garment structure (i.e., along the garment wearer's spine). The vented zone 108 may be of any suitable or desired size, shape, arrangement, or dimension without departing from the invention, for example, depending on the overall size of the garment 100. In at least some examples, for a center back vented zone like zone 108 shown in FIG. 1, the zone may be at least about 20 $in^2$, and in some examples, it may be at least about 30 $in^2$, or even at least about 40 $in^2$ or 80 $in^2$ or larger. For a generally rectangular vented zone, like that illustrated in FIG. 1, the zone 108 (or at least a portion thereof) in some examples may be 2-6 inches wide (dimension "W" in FIG. 1). In some examples, at least a portion of the vented zone 108 may be from about 2 to about 5 inches wide or from about 3 to about 5 inches wide. In still other more specific examples, men's garments may have an about 4 inch wide center back vented zone 108, and women's garments may have an about 3 inch wide center back vented zone 108.

The overall length (dimension "L" in FIG. 1) of a generally rectangular center back vented zone 108 like that illustrated in FIG. 1 also may vary, for example, depending on the overall size of the garment. As examples, the center back vented zone 108 may extend from proximate to the neck opening 102 in the garment structure 100 to a waist area of the garment structure 100 (i.e., the area where a wearer's waist would be located when the garment 100 is worn), as shown in FIG. 1. In numerical terms, the center back vented zone 108 in at least some examples of the invention may extend at least 10 inches (dimension "L"), or even at least 15 inches or at least 20 inches or more in some examples. "Proximate" to the neck opening 102, as used in this example (and as also generally used in this specification), means having an end within about 3 inches from the neck opening 102. Vented zones terminating or beginning at an opening are considered to be located "proximate to" the opening, for purposes of this specification.

Figure 2:
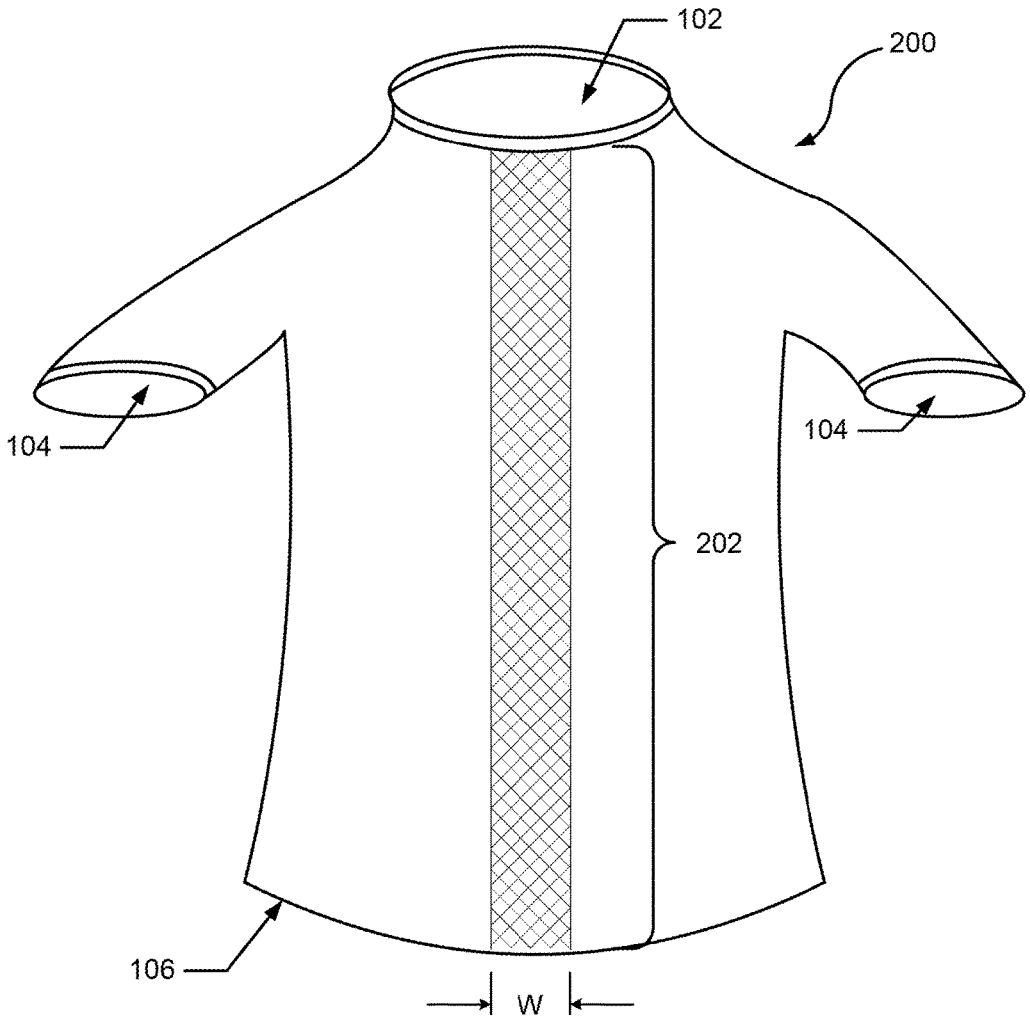
FIG. 2 illustrates another example upper torso garment in accordance with the invention having a center back vented zone.

FIG. 2 illustrates another example garment 200 in accordance with some aspects of this invention. In this example, the center back vented zone 202 extends essentially the entire length of the center back of the garment 200, i.e., from at the neck opening 102 (or closely proximate to it) to the waist opening 106 (or closely proximate to it). The term "closely proximate," as used in this example (and as also generally used in this specification), means having an end within about 1 inch from the respective opening in the garment. Vented zones terminating or beginning at an opening are considered to be located "closely proximate to" the opening, for purposes of this specification.

Figure 3:
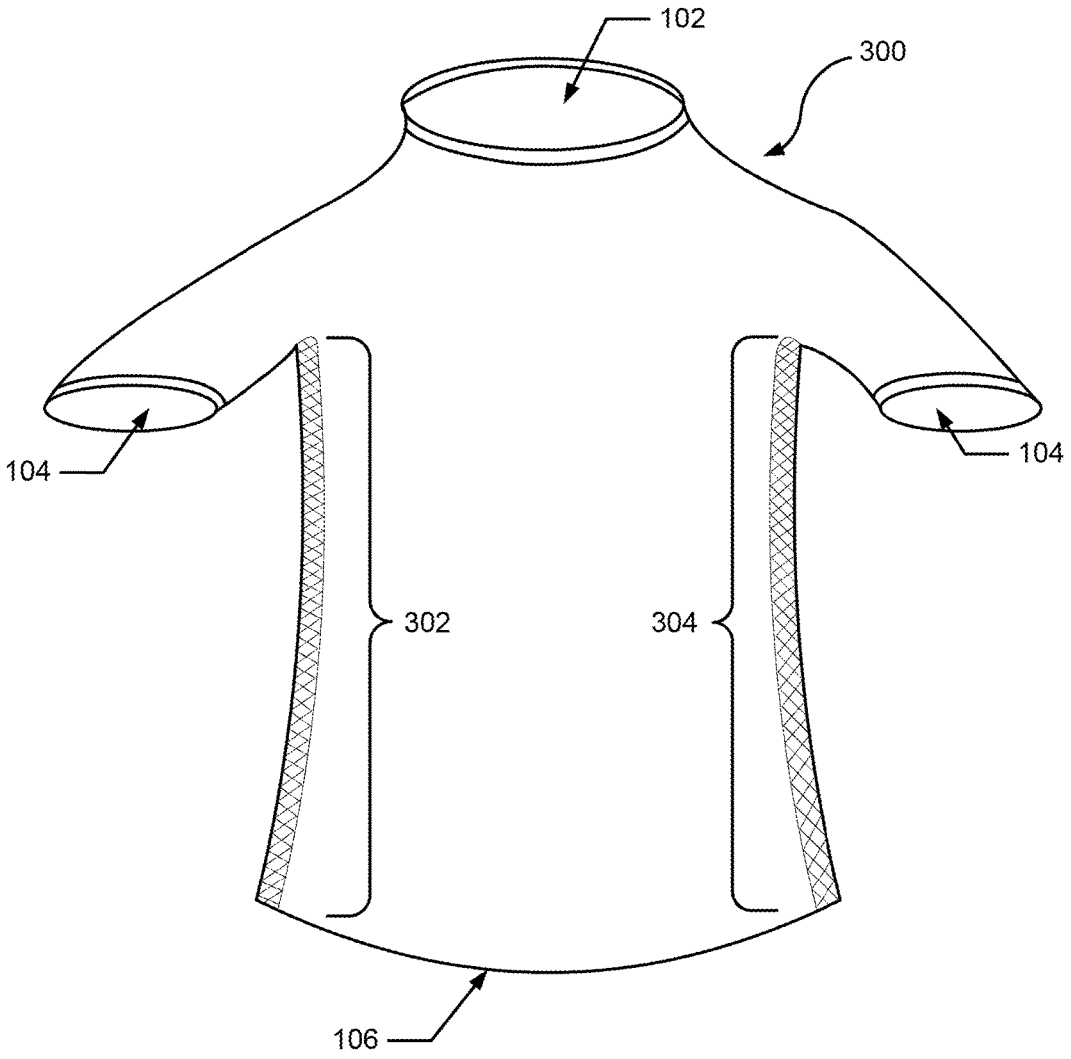
FIG. 3 illustrates an example upper torso garment in accordance with the invention having two side vented zones.

Another example of a garment 300 in accordance with at least some aspects of this invention is illustrated in FIG. 3. In this example, the garment 300 includes two vented zones 302 and 304, one zone located beneath each of the garment structure's sleeves and extending toward the garment structure's waist opening 106. For these side vented zones 302 and 304, the various sizes, shapes, arrangements, and dimensions also may vary without departing from the invention, for example, depending on the overall size of the garment. Additionally, the dimensions, size, shape, and arrangement of a side vented zone need not be identical to those of the vented zone on the opposite side of the garment, although the vented zones may be the same without departing from the invention. As some examples, each side vented zone 302 and 304 may be at least about 12 $in^2$, and in some examples, at least about 20 $in^2$ or even at least 30 $in^2$ or more. For generally rectangular shaped vented zones, like those illustrated in FIG. 3, at least a portion of each side vented zone 302 and 304 may be about 2 to about 6 inches wide and extend at least partially down the side portion of the garment 300 (e.g., to be located immediately beneath the user's arms and at the user's sides when wearing the garment 300). In some examples, at least a portion of the side vented zones 302 and 304 may be from about 2 to about 5 inches wide or from about 3 to about 5 inches wide. As still more specific examples, men's garments may have side vented zones 302 and 304 that are about 3 inches wide, and women's garments may have side vented zones 302 and 304 that are about 2.5 inches wide.

The overall length of the side vented zones 302 and 304 also may vary without departing from the invention, for example, depending on the size of the garment. As examples, the side vented zones may extend from proximate to (or closely proximate to) an armpit seam or proximate to (or closely proximate to) an arm opening (e.g., along the garment's sleeves or at an arm opening for a tank top type garment) in the garment structure 300 to a waist area of the garment structure 300. In other examples, each side vented zone 302 and 304 may extend proximate to or closely proximate to a waist opening 106 in the garment structure 300, as illustrated in FIG. 3. For some more specific numeric examples, the side vented zones 302 and 304 may extend at least 6 inches along the side of the garment structure 300, and even at least 10 inches or at least 15 inches in other examples.

Figure 4:
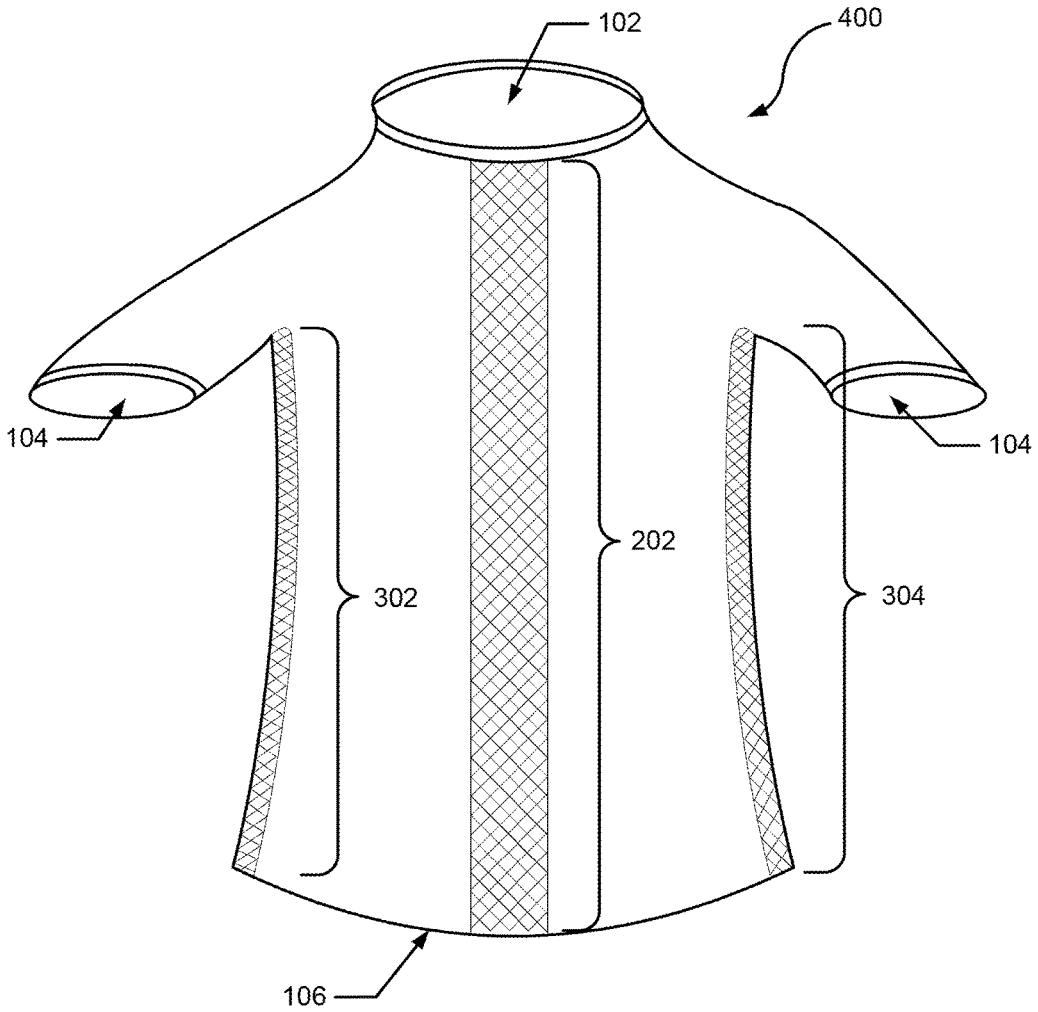
FIG. 4 illustrates an example upper torso garment in accordance with the invention having a center back vented zone and two side vented zones.

FIG. 4 illustrates another example garment structure 400. In this illustrated example, the garment structure 400 includes both a center back vented zone 202 and two side vented zones 302 and 304. While the illustrated example garment structure 400 shows the vented zones extending all the way or closely proximate to the waist opening 106, the various vented zones 202, 302, and 304 can take on any suitable dimensions, size, arrangement, and shape without departing from the invention, including, for example, the various dimensions, sizes, arrangements, and shapes described above. As some more specific examples, one or more of the vented zones 202, 302, and 304 could end generally in the waist area of the garment structure 400 (rather than at or proximate to the waist opening 106), one or both of the side vented zones 302 and 304 could extend all the way to the arm openings 104, or the like.

Figure 5:
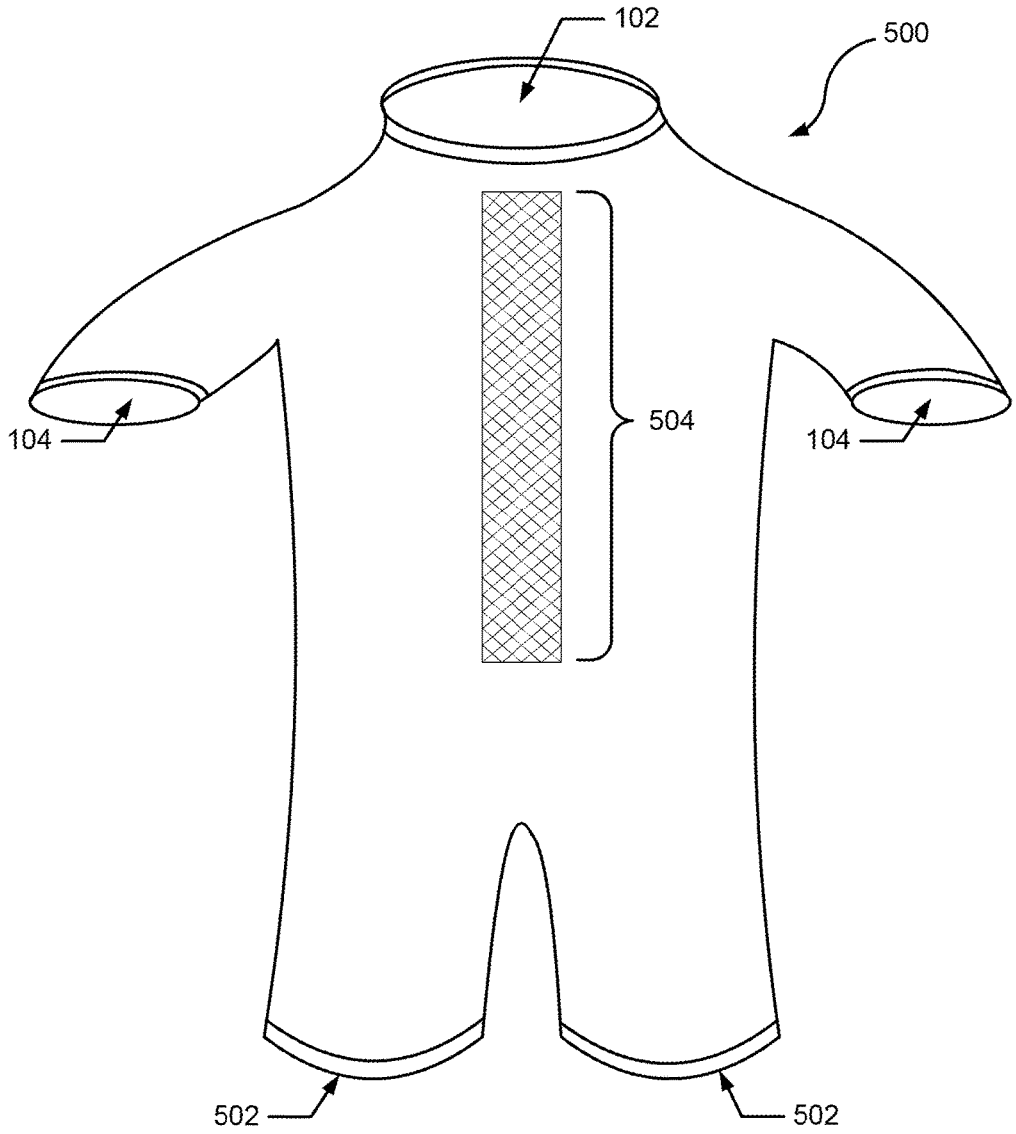
FIG. 5 illustrates another example garment in accordance with the invention having a center back vented zone.

Aspects of this invention are not limited to use with jerseys, tank tops, and other garments for covering only the upper torso of a wearer. FIG. 5 illustrates another example garment structure 500 in which aspects of the invention may be used. In FIG. 5, the garment 500 is a leotard or track suit type garment that at least partially covers both the wearer's upper torso and lower torso. As illustrated, this example garment structure 500 includes a neck or head opening 102, two arm openings 104, and two leg openings 502. In this example, the garment structure 500 includes a single center back vented zone 504 that extends from proximate to the neck opening 102 down to the waist area of the garment structure 500. The vented zone 504 may take on any desired size, shape, dimensions, and arrangement, including the various sizes, shapes, dimensions, and arrangements described above in conjunction with FIGS. 1, 2, and 4.

Figure 6:
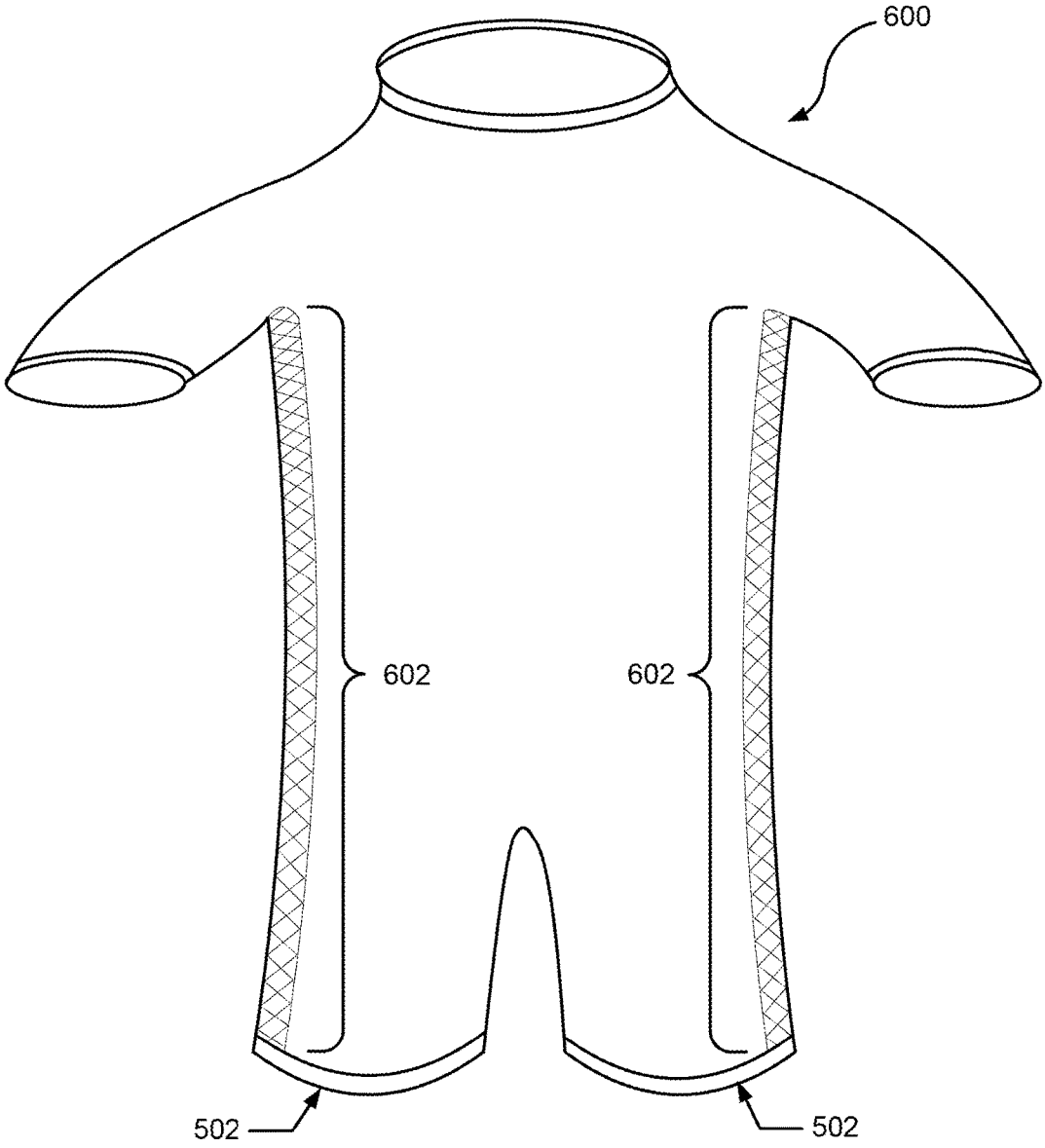
FIG. 6 illustrates another example garment in accordance with the invention having two side vented zones.

FIG. 6 illustrates another example leotard or track suit type garment structure 600 in accordance with aspects of this invention. In this example, rather than a center back vented zone, vented zones 602 are provided along each side of the garment structure 600. While in the illustrated example each side vented zone 602 extends all the way down and closely proximate to leg opening 502, any suitable or desired size, shape, arrangement, and dimensions may be used for the side vented zones 602, including the various sizes, shapes, arrangements, and dimensions described above in conjunction with FIGS. 3-4.

Figure 7:
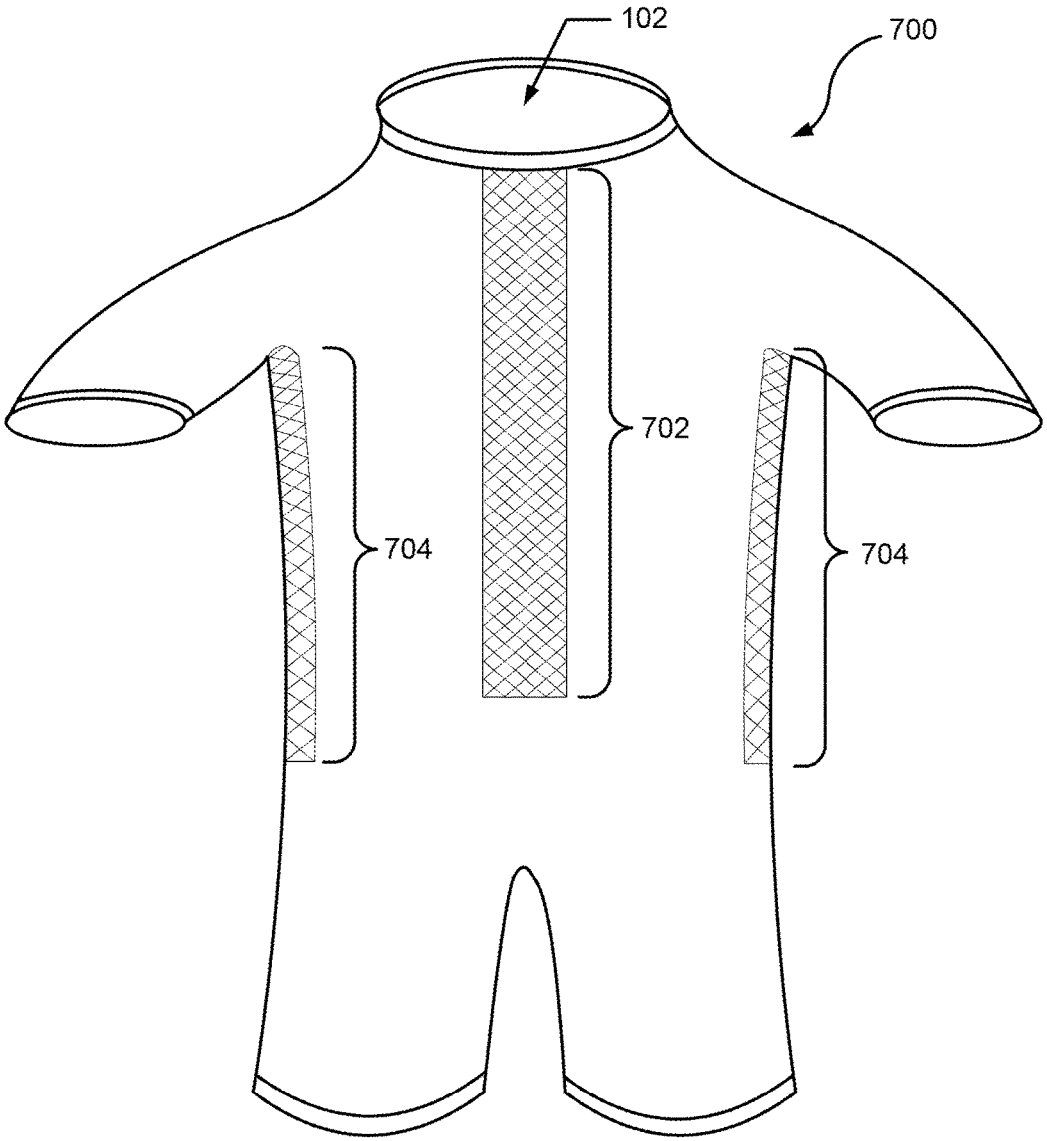
FIG. 7 illustrates another example garment in accordance with the invention having a center back vented zone and two side vented zones.

FIG. 7 illustrates another example leotard or track suit type garment structure 700 in accordance with some examples of this invention. In this example, the garment structure 700 includes a center back vented zone 702 and two side vented zones 704. The example illustrated in FIG. 7 illustrates various other dimensions and arrangements of the vented zones 702 and 704 within the garment structure 700. For example, in the structure 700 of FIG. 7, the center back vented zone 702 extends substantially all the way or closely proximate to the neck opening 102 in the garment structure 700. The side vented zones 704 and the center back vented zone 702 in this example all terminate at their lower ends in the waist area of the garment structure 700. Of course, any suitable or desired size, shape, arrangement, and dimensions may be used for the various vented zones 702 and 704 without departing from the invention, including the various sizes, shapes, arrangements, and dimensions described above in conjunction with FIGS. 1-6.

Figure 8:
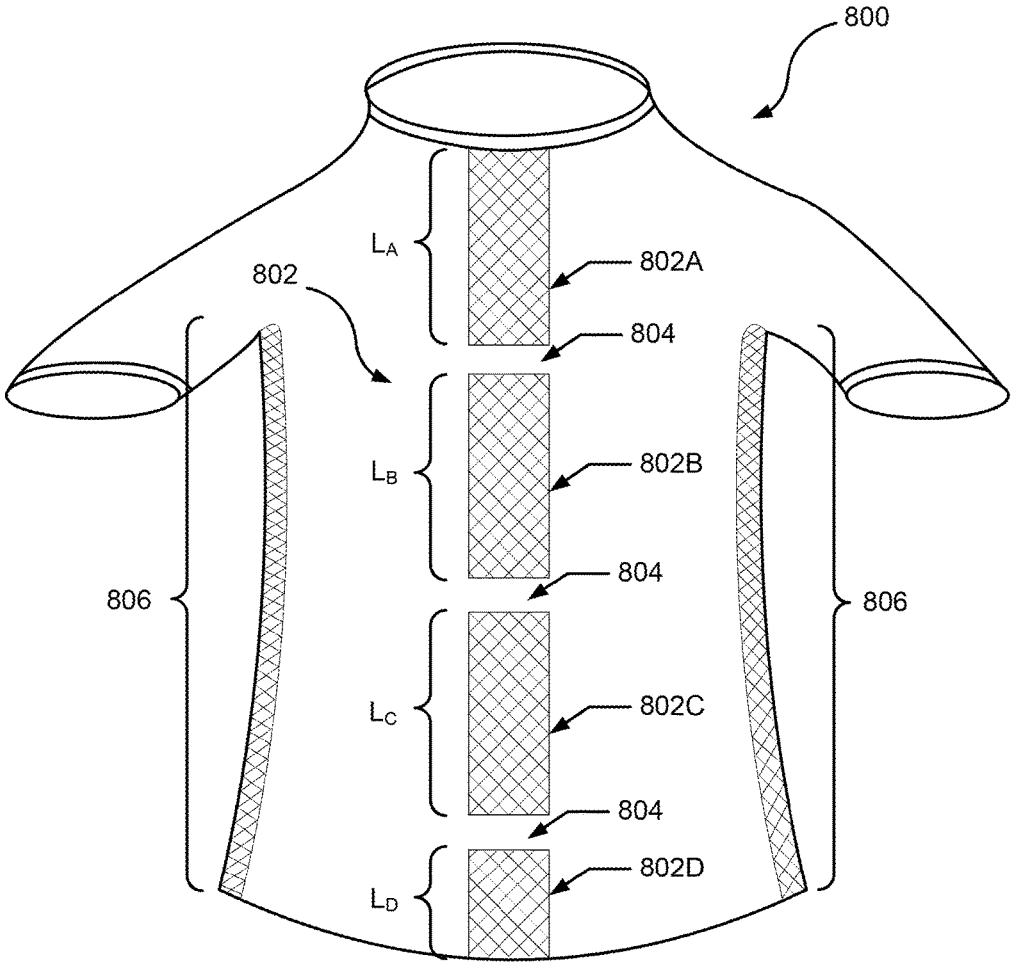
FIG. 8 illustrates an example garment in accordance with the invention in which one vented zone is discontinuous.

The various vented zones in a garment structure (e.g., the center back vented zone and/or one or more the side vented zones) also may be continuous or discontinuous, for example, over their width and/or length and/or other dimensions, without departing from the invention. FIG. 8 illustrates an example garment structure 800 in which the center back vented zone 802 is discontinuous over its length, but the side vented zones 806 are continuous over their lengths. As illustrated, vented zone 802 is made up of four distinct vented zone regions, namely regions 802A, 802B, 802C, and 802D, wherein the material of the remainder of the garment (e.g., material having an air permeability less than 600 $ft^3$/minute/$ft^2$) is provided between the vented zone regions 802A, 802B, 802C, and 802D (i.e., in the regions labeled 804). Any number of vented zone regions may be included in a garment structure without departing from the invention. In at least some examples, the overall length of the vented zone 802, which corresponds to the sum of the lengths of the vented zone regions 802A through 802D (i.e., $L_A+L_B+L_C+L_D$), may be at least 10 inches, or even at least 15 inches or at least 20 inches or more in some examples. Alternatively, in at least some examples, any one or more individual vented zone region 802A through 802D may be at least 10 inches long, or at least 15 or 20 inches long without departing from the invention.

Figure 9:
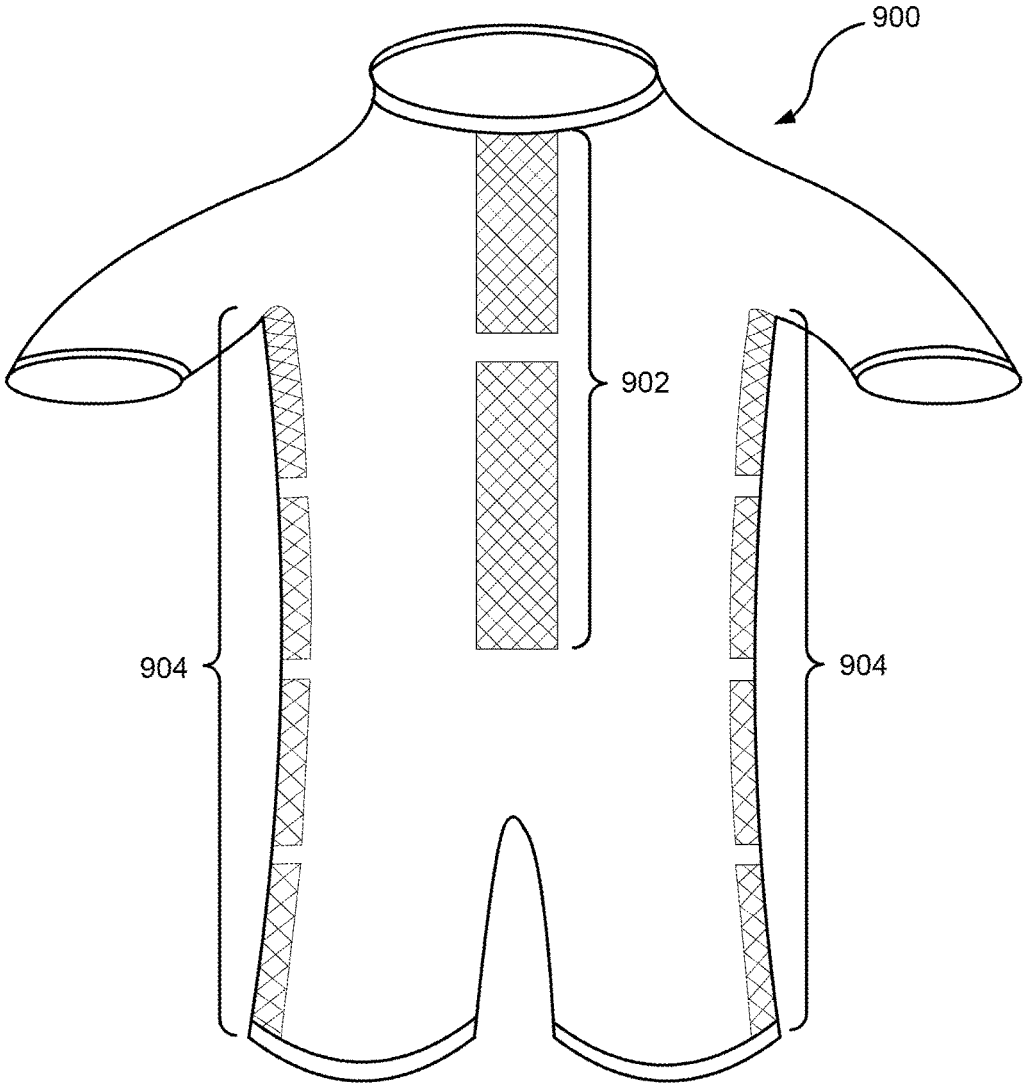
FIG. 9 illustrates an example garment in accordance with the invention in which all of the vented zones are discontinuous.

FIG. 9 illustrates another example of a garment structure 900 of the leotard or track suit type in which all of the illustrated vented zones are discontinuous. Specifically, in this example, both the center back vented zone 902 and the side vented zones 904 are discontinuous and composed of a plurality of vented zone regions. The size, shape, arrangement, and dimensions of the various vented zones 902 and 904 and their associated vented zone regions can vary widely, including, for example, in the various manners described above in conjunction with FIGS. 1-8.

Garments in accordance with aspects of the present invention may be made from any desired material without departing from the invention, including from conventional materials known to those skilled in the art. In at least some examples of the invention, the fabric material forming the vented zone(s) may be a mesh type material or a material formed to include mesh openings, while the fabric material making up the other portions of the garment may be a non-mesh material (or not processed to include mesh openings and/or containing fewer mesh openings). The garment portions other than the portions including the vented zones, in at least some examples of the invention, may make up a majority of the garment structure and/or may cover a majority of the upper torso and/or the lower torso of the wearer.

As mentioned above, the entire garment may be made from a single type of material (and even from a single piece of material), in at least some examples of the invention, but the material provided in the vented zones of the garment may be processed or otherwise altered in some manner to increase its air permeability (and thereby provide the vented zone). Such processing may include, for example: laser treatments (to perforate the material and/or provide a mesh structure); calendaring, rolling, and/or other physical treatments to perforate the material and/or provide a mesh structure; stretching the fabric and/or weave (to increase inter-fiber distance); and the like. Additionally or alternatively, in some examples, the entire garment may be made from a single type of material, but material provided in the portions of the garment not including the vented zones may be processed or otherwise altered in some manner to reduce its air permeability (e.g., by heat treatment to reduce inter-fiber distance in the weave, by applying a second layer or ply, and the like). As still another alternative, different types of weaves and/or yarn or fiber thicknesses may be used in the various regions of the garment structure to provide the vented regions and/or the less air permeable regions. The processing or other activity to alter the air permeability of at least some portion of the garment, if any, may take place either before or after the actual garment structure is formed (e.g., sewn together) without departing from the invention.

In still other examples, garments in accordance with the invention may be made such that different types of material (and/or different pieces of material) make up the various portions of the garment structure. Such pieces of material may be sewn together and/or otherwise joined together to form a garment structure in any suitable or desired manner without departing from the invention, including in conventional manners known in the art. Any desired number of different types of materials and/or materials having different air permeability characteristics may be included in garments without departing from the invention. Additionally, if desired, the materials used for creating the various vented zones may be the same or different within a single garment, and, if desired, the different vented zones may have different air permeability characteristics with respect to one another within a single garment.

Examples of suitable materials for the garments in accordance with the invention include both natural and synthetic materials and mixtures thereof. More specific examples of suitable natural materials include: leathers, cotton materials, wool materials, silk materials, and the like. More specific examples of synthetic materials include: polyesters, vinyls, nylons, rubbers, spandex, polyester microfibers, polyester microfiber cotton blends, polyester microfiber cotton spandex blends, and the like. In some examples, garments in accordance with the invention may include peppermint coated or infused fabric or fibers, as described in more detail below.

Additional aspects of the invention relate to methods for forming garments like those described above. Such methods may include, for example: (a) providing a first garment portion formed of a fabric material, wherein the first garment portion has an air permeability of less than 550 $ft^3$/min per $ft^2$; (b) providing a second garment portion including a first vented zone, wherein a material forming the first vented zone has an air permeability of at least 550 $ft^3$/min per $ft^2$; and (c) forming a garment structure including at least the first garment portion and the second garment portion, wherein the first vented zone extends along a center back portion of the garment structure or along a side portion of the garment structure. Optionally, as described above, vented zones, like those described above, may be provided in the center back portion, along one side, and/or along both sides of the garment structure without departing from the invention. Alternatively, garments may be formed for covering other portions of the body and/or the vented zones may be provided at locations other than and/or in addition to the garment's back center or sides.

The various method steps described above may take place in any order without departing from the invention. For example, as mentioned above, the garment may be formed first (e.g., from a single type of fabric material), and then the vented zone or zones may be provided (at the appropriate desired location(s)) by increasing the air permeability of the fabric at the vented zone location (e.g., by perforating the fabric, by laser treatment, by creating a mesh structure, by eliminating a layer or ply of material, by stretching the fabric, or in any other suitable or desired manner). As another option, two different garment portions (having different air permeabilities, and optionally formed of different types of materials) may be provided and then the garment structure may be formed in any suitable or desired manner, for example, by sewing the garments portions together (optionally with an intervening fabric between the two garment portions), or in any other conventional manner.

The vented zones also may take on any suitable or desired color or shape without departing from the invention. As examples, the garment portion(s) including the vented zones may be made a different color from the garment portions having a lower air permeability, and indeed the various vented zones may be differently colored from one another. As another example, there is no need to make the vented zones in a rectangular shape as illustrated in FIGS. 1-9, but rather, the vented zones may be round, oval, elliptical, or any other desired shape without departing from the invention. Different shapes may be used in a single garment or in a single vented zone. If desired, the vented zones themselves and/or discontinuities in the vented zone structures may be used, for example, to form or partially form printed information, logos, trademarks, designs, and the like in the garment structure. Any type of information or design may be included or formed by the vented zones and discontinuities in the vented zones without departing from this invention.

2. Aspects of the Invention Relating to Pre-Cooling and Body Temperature Regulation and Reduction Additional aspects of the invention relate to apparel and/or equipment technology that may be pre-wetted and used, e.g., in a predetermined protocol, prior to, during, and/or after an athletic event or exercise routine, in an effort to cool the athlete's body and/or regulate or reduce the body's temperature. Such pre-cooling and/or temperature maintenance and reduction efforts may help slow the rise of the body's core temperature before and during the event or exercise, and also reduce the temperature after the event or exercise, using both evaporative and conductive cooling processes (e.g., evaporative cooling like the sweating process described above, and conductive cooling when the pre-wetted garment or equipment may be used as a medium to conduct heat from the warm skin to the cooler air, thereby leaving the body cooler).

In at least some examples of the invention, at least some portion of an athlete's apparel or equipment may be pre-wetted with water (or another desired liquid) before the event or exercise begins, and this pre-wetted apparel or equipment then may be worn by the athlete. Therefore, when the wetted apparel or equipment is donned by the athlete, the athlete's core body temperature has not yet risen as a result of the physical exertion associated with the event or exercise, and the sweating response (in at least some instances) has not yet been triggered. While not wishing to be bound by any particular theory or method of operation, it is believed that wearing the garment or equipment in a pre-wetted condition before the event or exercise begins will cool the outer layer of the athlete's body and the blood contained in that layer. Once the event or exercise starts (the athlete optionally may remove all or part of the pre-wetted garment during the event or exercise, if desired), increased blood circulation moves warmer blood from the body's core to the cooler outer body layer, and the continuing circulation moves cooler blood from the body's outer layer to its core. This action has been shown to contribute to a slower rise in core body temperature during the event or exercise. After the event or exercise, the wetted apparel or equipment (or another piece of wetted apparel or equipment and/or a rewetted piece of apparel or equipment) may be used (re-donned, if necessary) to speed up cooling of the body, which results in a faster drop in the core body temperature. This procedure, while effective and useful, is not recommended as a method of choice for the medical treatment of hyperthermia.

Any suitable or desired piece of apparel, garment, or equipment may be pre-wet and used in methods according to examples of the invention. For example, in at least some instances, a piece of apparel having zoned venting, like those described above in conjunction with FIGS. 1-9, may be pre-wet and used in the various example pre-event or exercise cooling protocols (as will be described in more detail below). As another example, a piece of pre-wetted apparel or equipment may be used for pre-event or routine cooling, doffed immediately prior to the event or exercise routine, and then a piece of apparel having zoned venting like that described above, can be donned for the actual event or exercise. Optionally, if desired, a garment having zoned venting can be worn under the pre-wetted piece of apparel or equipment such that this garment will remain when the pre-wetted garment is doffed for the event or routine.

While various pre-event or routine body cooling protocols may be used in accordance with examples of the invention, some more specific examples of suitable protocols follow. In at least some examples, a piece of apparel or other equipment in accordance with aspects of this invention may be pre-wet with a predetermined amount of water, e.g., using at least about 0.5 ml of water per gram of dry fabric. In some examples, garments or other equipment in accordance with aspects of the present invention may be sold in or with a water-tight container, optionally in a pre-wetted condition. The volume of water needed to pre-wet the apparel or equipment may vary, e.g., depending on the material type; the apparel size, configuration, or style; the degree of wetness desired; ambient temperature; the type or length of event or routine; etc.

In one pre-event or pre-exercise cooling protocol, the pre-wetted apparel or equipment initially may be donned by the athlete some time prior to the start of the event or exercise routine, e.g., at least 20 minutes before the event or exercise routine is to start, and in some examples at least 25, 30, or even 40 minutes before the event or exercise routine is to start. As part of this example pre-event or exercise cooling protocol, the athlete then will stay in the coolest environment reasonably available (e.g., in the shade, in the locker room, in air-conditioning, near a fan or other cooling device, and the like) for at least about 20 minutes, while resting and/or with minimal physical activity, to support maximum pre-event cooling. If necessary or desired, the apparel or equipment may be re-wet as needed during this pre-event cooling time period.

As the start of the event approaches, the athlete may need or desire a warm-up time period. If a warm-up is desired, the athlete may start the warm-up (e.g., a light warm up) about 20 minutes or less, and in some examples, about 10 minutes or 15 minutes or less, before the event or exercise routine is to begin. In at least some examples, the pre-wetted apparel or equipment may continue to be worn during this warm-up period. In this manner, when the athlete begins the event or exercise, he or she will be stretched and warmed up, but the body still will be somewhat cooler than would be the case without this pre-cooling regimen.

During the event or exercise routine, in at least some examples, the athlete may wear the pre-wetted apparel or equipment, if desired or allowed by the rules of the competition. Doing so may help further reduce the rate-of-rise in the athlete's core body temperature during the physical exertion associated with the event or exercise. Additionally, as noted above, a pre-wetted piece of apparel or equipment also may be worn after the event or exercise routine, to enhance cooling. Alternatively, in some examples, a portion of the wetted piece of apparel or equipment may be removed for the event or routine, such as sleeves, pant legs, and the like.

A piece of apparel used in accordance with these aspects of the invention may be made from any desired natural, synthetic, or blended materials or combinations thereof, in any desired configuration, style, or combination, optionally with the vented zones as described above in conjunction with FIGS. 1-9. As examples, the piece of apparel may be a T-shirt, jersey, pants, or track suit type garment (like those described above), of any desired size, optionally sleeveless, short-sleeved, long-sleeved, with removable sleeves, with removable pant legs, etc. In at least some examples of the invention, the apparel product for the pre-wetting protocol (optionally including the vented zones as described above) may be constructed from high-performance sweat management materials (e.g., like thin, lightweight fabrics made from or containing polyester microfibers, polyester microfiber cotton blends, polyester microfiber cotton spandex blends, polyester spandex blends, and the like) optionally, materials that have been infused with peppermint (e.g., materials including peppermint microcapsules in or adhered to at least some fibers making up the material, materials exposed to or coated with peppermint oil, materials having peppermint microcapsules or oil applied to the fibers via a binder or textile finish, or the like). Studies indicate that peppermint infused fabrics may help decrease an athlete's perception of how hard he/she is working, reduce fatigue, boost mood, and/or increase alertness. In some more specific examples, apparel in accordance with various aspects of this invention may be made from or include a "Sphere Dry" polyester knit material and/or a Dri-FIT polyester material, as included in various commercial products available from NIKE, Inc., of Beaverton, Oreg. Optionally, the Sphere Dry and/or Dri-FIT materials (or other materials, equipment, etc.) may be infused or coated with peppermint microcapsules or peppermint oil in any suitable or desired manner (e.g., bound to the fabric and/or applied as a fabric or textile finish).

Suitable peppermint microcapsules and/or peppermint oil are known in the art and commercially available, e.g., from International Flavors & Fragrances ("IFF").

Of course, variations and modifications of the pre-event or pre-exercise cooling protocol may be used without departing from the invention. For example, a limited amount of water may be used for the pre-wetting process, to avoid overly saturating the pre-wetted garment or equipment. As examples, for a T-shirt or jersey type garment, the garment may be pre-wet with 0.5 ml to 3 ml of water per gram of material in the piece of apparel (when dry). In some examples, the pre-wetting water amount may be about 0.8 to 1.5 ml of water per gram of dry material, and about 1 ml/g, in at least some examples. The various time periods described in the protocol above (e.g., the pre-event rest and cooling time period, the warm-up time period, and any desired post-event cool down time period) may vary widely, depending, for example, on athlete preference, the type of event or workout, the length of the event or workout, the ambient temperature, the energy expended during the event or workout, and the like.

Figure 10A:
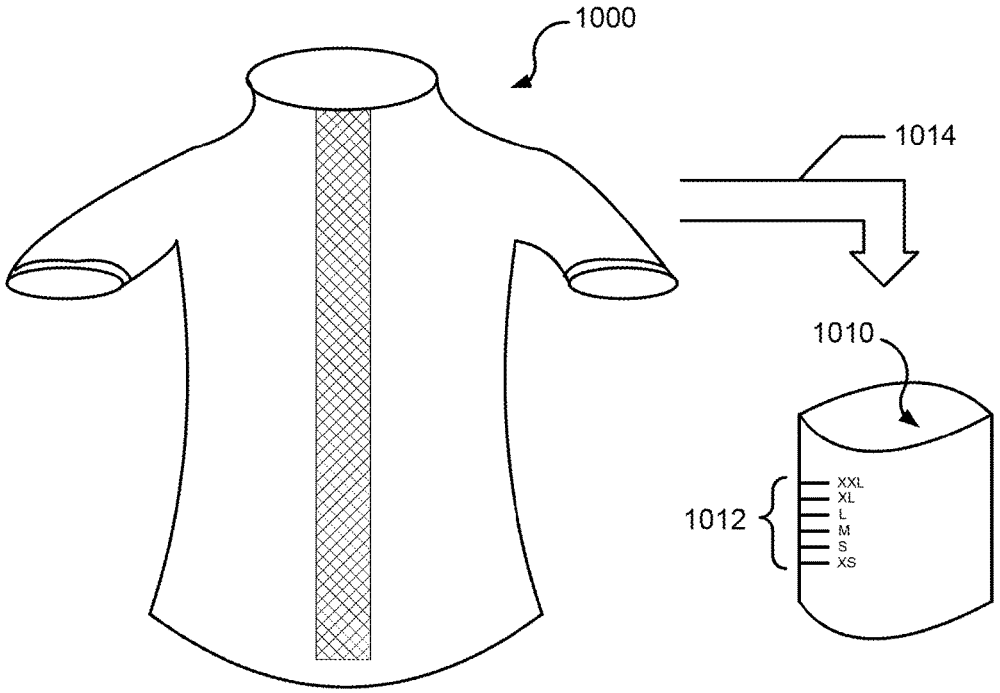
FIGS. 10A and 10B illustrate example protocols, methods, and/or packaging useful for pre-wetting a garment or other athletic equipment in accordance with at least some aspects of this invention.

As shown in FIG. 10A, in at least some instances, apparel or equipment 1000 used for pre-wetting protocols in accordance with aspects of the invention may include a container 1010 used for the pre-wetting process. The container 1010 may take on any suitable form, such as a bag, a plastic tube and cover assembly, and the like. The example illustrated in FIG. 10A shows a container 1010 in the form of a plastic or fabric bag, optionally a transparent bag that is recyclable and/or made from recycled material. In at least some examples, the container 1010 may be made of a material that can dry easily (e.g., does not substantially absorb or retain water) and one that is resistant to growth of mold, bacteria, and the like (or is treated to resist such growth). In some examples, the container 1010 may include markings, gradations, or other indicia 1012 thereon, e.g., akin to markings on a measuring cup, to indicate an appropriate amount of water to add into the container 1010 for apparel wetting purposes, e.g., for various garment 1000 sizes and/or characteristics. Any suitable style of indicia 1012, form or mechanism for including the indicia 1012, or information may be included in the indicia 1012 without departing from the invention. As another example, the container 1010's size may be selected, e.g., based on the associated garment's size and/or other characteristics (such as material type), such that when the garment 1000 is placed in the container 1010, the container 1010 then may be filled or substantially filled with water, to thereby provide the appropriate water amount and pre-wetting level.

Figure 10B:
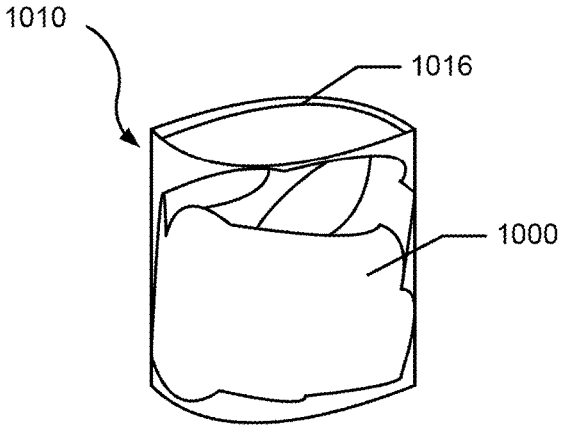

In use, water is added to the container 1010 to the appropriate level for the garment 1000 size, and the garment 1000 is placed in the container 1010 as shown by the arrow 1014 in FIG. 10A and as illustrated in FIG. 10B. Alternatively, the garment 1000 may be placed in the container 1010 and the water then added, as mentioned above. The container 1010 then may be closed and/or sealed in any appropriate manner (e.g., using a cover, a water tight zip-type seal 1016, by hand, etc.) if desired, and container 1010 and garment 1000 may be squeezed, shaken, and otherwise handled as needed to appropriately and uniformly wet the garment 1000. The garment 1000 then can be removed from the container 1010 and donned by the athlete, and the pre-event cooling time period may begin. Container 1010 (and this procedure) can be used repeatedly by the athlete, e.g., for numerous events or exercise outings, repeatedly over long events or outings, etc.

Optionally, if desired, in at least some instances, pieces of apparel and other equipment in accordance with the invention may be packaged for sale, distribution, and/or use in or along with a container like that illustrated in FIGS. 10A and 10B. Optionally, in at least some instances, the apparel or equipment may be packaged for sale, distribution and/or use in a container along with water or other liquid, in a pre-wetted condition.

D. Conclusion

Various examples of the present invention have been described above, and it will be understood by those of ordinary skill that the present invention includes within its scope all combinations and subcombinations of these examples. Additionally, those skilled in the art will recognize that the above examples simply exemplify the invention. Various changes and modifications may be made without departing from the spirit and scope of the invention, as defined in the appended claims.

The invention claimed is:

1. A method, comprising:

wetting a garment for at least an upper torso of a wearer, wherein the garment includes a head or neck opening, a waist opening, and two arm openings, and wherein the garment includes a first portion formed of a non-mesh fabric material having an air permeability of less than 550 $ft^3$/min per $ft^2$ measured according to ASTM D737-96 and a second portion including a mesh vented zone extending along a center back portion of the garment, wherein the mesh vented zone has an air permeability of at least 550 $ft^3$/min per $ft^2$ measured according to ASTM D737-96 and has an area of at least 20 $in^2$;

at least 20 minutes prior to a start of an event or exercise routine, wherein the event or exercise routine consists of physical activity that causes a wearer's body temperature to increase as a result of the physical activity, donning the wetted garment and wearing it in a wetted condition so as to cool a wearer's body prior to the start; and participating in the event or exercise routine.

2. A method according to claim 1, further comprising:

doffing the garment prior to participating in the event or exercise routine.

3. A method according to claim 2, further comprising:

donning the garment after the event or exercise routine has concluded.

4. A method according to claim 3, further comprising:

re-wetting the garment prior to donning it after the event or exercise routine has concluded.

5. A method according to claim 1, wherein the wetting includes placing the garment and a liquid in a container.

6. A method according to claim 1, wherein the mesh vented zone has a rectangular shape and has a width within a range of 3 inches and 5 inches.

7. A method according to claim 1, wherein the first portion includes two layers of the non-mesh fabric material.

* * * * *